US008402602B2

(12) United States Patent
Jonsson et al.

(10) Patent No.: US 8,402,602 B2
(45) Date of Patent: Mar. 26, 2013

(54) ACCESSORY UNIT OF A VACUUM CLEANER

(75) Inventors: Stefan Jonsson, Stockholm (SE); Esbjörn Svantesson, Täby (SE); Andreas Pohl, Bromma (SE); Tommy Lindquist, Farsta (SE)

(73) Assignee: AB Electrolux, Stockholm (SE)

( * ) Notice: Subject to any disclaimer, the term of this patent is extended or adjusted under 35 U.S.C. 154(b) by 587 days.

(21) Appl. No.: 12/664,180

(22) PCT Filed: Jun. 10, 2008

(86) PCT No.: PCT/SE2008/000385

§ 371 (c)(1), (2), (4) Date: Jun. 9, 2010

(87) PCT Pub. No.: WO2008/153467

PCT Pub. Date: Dec. 18, 2008

(65) Prior Publication Data

US 2011/0010888 A1 Jan. 20, 2011

Related U.S. Application Data

(60) Provisional application No. 60/945,201, filed on Jun. 20, 2007.

(30) Foreign Application Priority Data

Jun. 12, 2007 (SE) ..... 0701439

(51) Int. Cl.
*A47L 9/02* (2006.01)

(52) U.S. Cl. ..... 15/415.1; 15/400; 15/416; 15/417

(58) Field of Classification Search ..... 15/400, 15/415.1, 416, 417
See application file for complete search history.

(56) References Cited

U.S. PATENT DOCUMENTS

| | | | | |
|---|---|---|---|---|
| 4,897,894 | A * | 2/1990 | Fahlen | 15/365 |
| 5,502,870 | A | 4/1996 | Ragner et al. | |
| 6,536,076 | B2 * | 3/2003 | Leone et al. | 15/415.1 |
| 6,991,262 | B1 | 1/2006 | Ragner | |

FOREIGN PATENT DOCUMENTS

| | | |
|---|---|---|
| GB | 1186817 | 4/1970 |

* cited by examiner

*Primary Examiner* — Lee D Wilson
*Assistant Examiner* — Shantese McDonald
(74) *Attorney, Agent, or Firm* — Hunton & Williams LLP

(57) ABSTRACT

An accessory unit of a vacuum cleaner, alone, with a vacuum cleaner conduit, and with a vacuum cleaner. The accessory unit has a housing, a first tool end, and a second tool end for releasable connection to a vacuum cleaner conduit. The first tool end has a first nozzle for vacuum cleaning, and the second tool end has two pivotable arms for forming second and third nozzles. Each arm has distal and proximal ends. The distal ends are arranged to be brought together for forming the second nozzle, and to be spread apart for forming the third nozzle. Furthermore, the arms are folded together to bring the distal arm ends in vicinity of each other for releasable connection of the second tool end to the vacuum cleaner conduit by at least partial insertion into said vacuum cleaner conduit.

22 Claims, 3 Drawing Sheets

ACCESSORY UNIT OF A VACUUM CLEANER

This application claims priority to International Application No. PCT/SE2008/000385, filed Jun. 10, 2008 (now WO 2008/153467), which claims priority to both Swedish Patent Application No. SE 0701439-2 filed Jun. 12, 2007 and U.S. Provisional Application No. 60/945,201 filed Jun. 20, 2007, both of which are incorporated herein by reference.

FIELD OF THE INVENTION

The present invention relates to an accessory unit of a vacuum cleaner for releasable connection to a vacuum cleaner conduit. The accessory unit comprises first and second tool ends end for forming a first, a second and a third nozzle for vacuum cleaning. The present invention also relates to an arrangement comprising a vacuum cleaner conduit and the accessory unit, and a vacuum cleaner comprising the arrangement.

BACKGROUND OF THE INVENTION

On the market, there exists a wide range of vacuum cleaner accessories for combining nozzles for vacuum cleaning of different surfaces. These accessories are often referred to as multi-tools, multi-tool accessories, combination tools or combination nozzles. In general, the multi-tools combine two or more different nozzles, such as a brush nozzle, a crevice nozzle, a furniture nozzle and other types of nozzles. Before the introduction of multi-tool accessories, the different nozzles were manufactured as separate units. Hence, the multi-tool accessories seek to solve the problem of losing different nozzles by integrating the nozzles so as to form one unit. However, many of the currently available multi-tools are cumbersome to use due to their often bulky configurations.

U.S. Pat. No. 5,502,870 discloses a multi-function vacuum cleaner nozzle for attachment to an end of a vacuum cleaner hose. In an embodiment of the nozzle, it comprises a housing body, a dust brush and two pivotal cleaning arms. Each one of the pivotal cleaning arms defines an elongated air channel with open ends and has an inner and an outer end. The housing body has a first port and a second port, each port being adapted to receive a suction conduit, for connecting the nozzle to a vacuum cleaner via a vacuum cleaner hose. The first port comprises pivotable mounting means for pivotally connecting the inner ends of the arms to a tool end of the housing body. The second port is fitted with the dust brush, which snaps into a recess encircling the housing. A problem with the multi-function vacuum cleaner nozzle, as described above in U.S. Pat. No. 5,502,870, is that when attaching the tool end onto a vacuum cleaner hose for using the dust nozzle, the nozzle becomes large and bulky. As a consequence, the prior art multi-function vacuum cleaner nozzle may be impractical and unsuited for use in narrow and small spaces.

SUMMARY OF THE INVENTION

An object of the present invention is to alleviate at least one of the above-mentioned problems of the prior art.

This object may be met by an accessory unit for a vacuum cleaner as set forth in the appended independent claim.

According to a first exemplary aspect of the present invention an accessory unit of a vacuum cleaner is provided, wherein the accessory unit comprises a first tool end and a second tool end for releasable connection to a vacuum cleaner conduit and a housing for communicating vacuum suction air between the first and second tool end. The first tool end comprises a first nozzle for vacuum cleaning, and the second tool end comprises two pivotable arms for forming a second and a third nozzle for vacuum cleaning, wherein each arm comprises a distal and a proximal end. The distal ends of the pivotable arms of the second tool end are arranged to be brought together for forming the second nozzle, and to be spread apart for forming the third nozzle. Further, the arms of the second tool end are arranged to be folded together for releasable connection of said second tool end to said vacuum cleaner conduit by insertion of said arms at least partially into the vacuum cleaner conduit.

In a second exemplary aspect of the invention, there is provided an arrangement comprising a vacuum cleaner conduit and an accessory unit of a vacuum cleaner, as described in the preceding paragraph.

According to a third exemplary aspect of the invention, there is provided a vacuum cleaner comprising an arrangement as described above.

A basic principle of the present invention is that a tool end, comprising two pivotable arms, of an accessory unit is received by the interior of the vacuum cleaner conduit for releasable connection thereto. In other words, the vacuum cleaner conduit is arranged on the outside of the second tool end, with the arms thereof folded together and inserted into the conduit. In this manner, since the arms of the second tool end are at least partially located within the vacuum cleaner conduit when connecting the tool end to a vacuum cleaner conduit, a small and slender construction is provided.

The purpose of connecting the tool end to the vacuum cleaner conduit is to prepare the other tool end of the accessory unit, comprising a different nozzle, for vacuum cleaning. Thanks to the slender construction enabled by the configuration of the accessory unit according to the invention, especially when the tool end comprising the arms is connected to the vacuum cleaner conduit, vacuum cleaning with the other tool end of the accessory unit of tight and narrow spaces will become easier.

It should be noted that the term "folded together" is not limited to a configuration where the arms are brought into contact with each other for insertion into a vacuum cleaner conduit. Although the arms in some embodiments may be entirely brought together when arranged for insertion into a vacuum cleaner conduit, configurations and embodiments where the arms are folded towards each other but where a gap between the arms is maintained when the tool end is arranged for insertion into a vacuum cleaner conduit, are also contemplated within the scope of the present invention. It should also be noted that the accessory unit may be arranged such that the arms are, or are not, in contact with each other during initial insertion into a vacuum cleaner conduit, and become separated, or brought into contact, during the insertion procedure.

It is to be understood that the terms "proximal" and "distal" are to be taken in relation to the housing of the accessory unit. That is to say, the proximal end is the end closest to the housing, and the distal end is the end furthest away from the housing.

The accessory unit may comprise a first and a second tool end, wherein the second tool end comprises the abovementioned pivotable arms. Each tool end may comprise a nozzle or nozzles, where any one or all of the nozzles may be formed as integrated parts of the accessory unit, or may be arranged as separate, detachable parts. An advantage by having detachable nozzle parts is that worn out parts may be replaced.

Generally, the engagement between either tool end of the accessory unit and the vacuum cleaner conduit provides an air tight connection between the accessory unit and the vacuum cleaner conduit in order to maximize suction flow and the strength of said engagement. However, in particular embodiments, it may be advantageous to provide channels or passages at the engagement location, thereby preventing a completely air tight connection between the accessory unit and the vacuum cleaner conduit. If so, the non-air tight engagement could provide a desired decrease in suction force at the orifice of the nozzle, whereby movement of the nozzle is facilitated, as well as a reduction in the level of noise produced by the suction flow.

In embodiments of the accessory unit, the unit comprises a section having a diminishing cross section in the longitudinal direction of the accessory unit, towards the distal end of the arms. The tapered section may extend all the way to the distal ends of the arms, or along only a portion thereof. The interior engagement surface of the vacuum cleaner conduit is then suitably arranged to bear, at least partially, against the tapered section during mounted engagement with the second tool end.

Advantageously, the section for engagement with the vacuum cleaner conduit has a continuous tapering form. In addition to providing an easy mounting and secure connection between the accessory unit and the vacuum cleaner conduit, it also provides the possibility to connect different vacuum cleaner conduits having different sizes and/or shapes to the second tool end of the accessory unit.

Moreover, it may also be desirable to design the tapered section by gradually decrementing, e.g. stepwise, a cross section area of the accessory unit in a direction towards the distal end of the second tool end. In this manner, a stepwise tapering can be provided for connection of a vacuum cleaner conduit having a specific size and/or shape that fits snugly with the step. It may be preferred to provide a number of steps for fitted connection of different vacuum cleaner conduits having different sizes and/or shapes.

In embodiments of the accessory unit, the tapered section, or individual steps of the tapered section, may have a frustoconical shape.

Furthermore, the tapered section may be provided on the outer surface of the housing of the accessory unit, whereby the entire length of the arms of the second tool end may be fitted inside the vacuum cleaner conduit. Then, the arms may be arranged within the conduit such that they do not necessarily bear against each other in a tight or snug fashion. In other words, the proximal ends of the arms do not need to be in contact with each other for providing a sealed connection between the accessory unit and the vacuum cleaner conduit.

In further embodiments, the tapered section may be provided on the outer surface of each of the arms of the second tool end, thereby forcing the arms of the second tool end tighter together during mounting and insertion of the arms into a vacuum cleaner conduit. Consequently, the taper would assist in achieving a sealed connection between the arms. As understood by the skilled person, the forces bringing the arms towards each other are generally further assisted by the provided suction flow.

In some embodiments, there is formed, inside the vacuum cleaner conduit, at least one projection for keeping the arms of the second tool end at least slightly separated when connecting the second tool end to the vacuum cleaner conduit. Such projection might be located in the vicinity of, i.e. close to, the vacuum cleaner conduit opening towards the accessory unit, according to embodiments of the present invention. Preferably, two projections are provided inside the vacuum cleaner conduit. The projections may be arranged to engage at the proximal or distal ends of the arms, or between said ends, for separating the arms. When the arms are forced or held apart by the projections, a larger air flow is enabled through the accessory unit as compared to when the arms are resting against each other.

It should be noted that it may be necessary to provide an additional sealing at the proximal ends of the arms at the second tool end in order to provide an air tight connection between the accessory unit and the vacuum cleaner conduit. If the accessory unit is shaped such that the entire arms of the second tool end are completely fitted inside the vacuum cleaner conduit, there will be no need for an additional sealing at the proximal ends of the arms, i.e. at the mounting thereof to the accessory unit housing.

In still further embodiments of the accessory unit, the second tool end has a non-circular cross section, when the arms of the second tool end are folded together for insertion into the vacuum cleaner conduit or when brought together for forming the second nozzle. The cross section may preferably have an oblong configuration, most preferably in the form of an ellipse or a super-ellipse.

The open end may in embodiments of the invention be circular.

However, non-circular shapes as described above are preferred since a non-circular shape prevents the accessory unit from rotating about the longitudinal axis of the second tool end. In this manner, the accessory unit may be guided for insertion at a specific rotational angle about the longitudinal axis of the second tool end.

In embodiments of the arrangement including a vacuum cleaner conduit, at least an end thereof, arranged for receiving the tool ends of the accessory unit, may be provided with a non-circular cross sectional configuration. The cross section may preferably have an oblong configuration, most preferably in the form of an ellipse or a super-ellipse.

In preferred embodiments of the accessory unit, the distal ends of the arms are open, thereby enabling a longitudinal flow through the open distal ends and along each of the arms, respectively. The open ends of the arms, when the arms are brought together for forming the second nozzle, form a suction flow opening at the distal end of the second nozzle.

In preferred embodiments of the accessory unit, an angle is formed between the longitudinal axis of the first tool end and the second tool end. In other words, the housing of the accessory unit has an angled or curved longitudinal configuration, i.e. in the flow direction. Preferably, the angle is in the range from 0° to about 90°, most preferably approximately 60°.

In further embodiments, the accessory unit is arranged such that the angle between the longitudinal axes of the first and second ends is adjustable. For instance, the housing may be provided as two parts, which e.g. are pivotally mounted to each other. The possibility of adjusting said angle, and thereby optimizing the angle to the different vacuum cleaning conditions, may further improve the flexibility and user-friendliness of the accessory unit and the vacuum cleaner.

Moreover, the arms of the second tool end are in preferred embodiments mounted to be swung or pivoted about their proximal ends. Each arm of the second tool end of the accessory unit according to an embodiment of the present invention is mounted onto the housing with hinge means arranged such that the arms are pivotable in a common plane.

In embodiments of the invention, at least one of the pivotable arms may be provided with apertures, for providing a supply of air into the suction flow, for the purpose of reducing the suction flow through the distal end of the second nozzle. Thereby, a reduction of the level of noise produced when using the second nozzle during vacuum cleaning may be obtained.

Furthermore, in embodiments of the invention, the first nozzle takes the form of a brush nozzle, the second of a crevice nozzle and the third nozzle may take the form of a furniture nozzle. Thus, the second tool end comprising the pivotable arms are then arranged for forming a crevice nozzle, with the arms brought together, and a furniture nozzle, with the arms spread apart. In this way, the accessory unit according to embodiments of the present invention presents three different nozzles, all arranged in a single slender unit. As understood by the skilled person, further alternative combinations of different types of vacuum cleaner nozzles may be anticipated within the scope of the invention. For instance, the brush nozzle may be replaced by a nozzle for a radiator tool or the like.

BRIEF DESCRIPTION OF THE DRAWINGS

The various exemplary aspects of the invention, including its particular exemplary features and advantages, will be readily understood from the following detailed description and the accompanying drawings. In the drawings.

DETAILED DESCRIPTION OF EMBODIMENTS OF THE INVENTION

Figure 1:
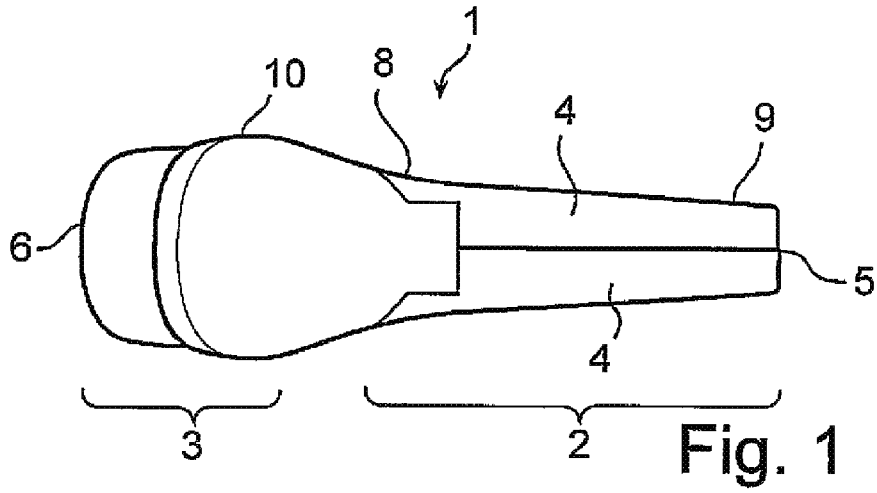
FIG. 1 is a top view of an accessory unit for a vacuum cleaner according an embodiment of the present invention.

Throughout this description, the same reference numerals have been used to denote similar elements when applicable.

Figure 7:
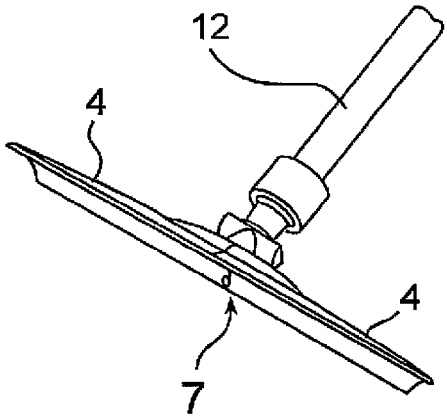
FIGS. 7-11 show in simplified schematic form the general operation of an accessory unit according to embodiments of the present invention.
Figure 9:
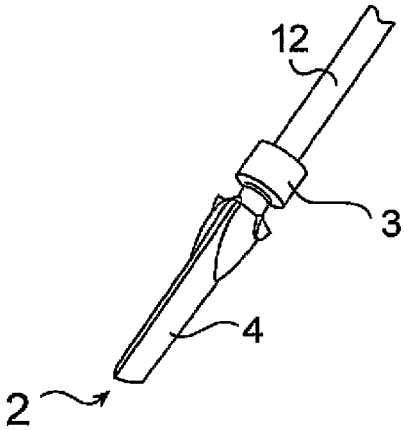

In FIG. 1, there is shown a top view of an accessory unit 1 for a vacuum cleaner (not shown) according an embodiment of the present invention. The accessory unit 1 comprises a housing 10, a first tool end comprising a brush nozzle 3 and a second tool end 2, comprising two pivotally mounted arms 4. The reference numeral "3" denotes both the first tool end and the brush nozzle. Each arm 4 has a proximal end 8 and a distal end 9. The brush nozzle 3 has an orifice 6 for releasable connection to a vacuum cleaner conduit, i.e. a connector of a hose of a vacuum cleaner. At the distal end 9 of each arm 4 there is an opening 5 for suction of dust or the like, when the second tool end 2 of the accessory unit is used as a crevice nozzle, as shown in FIGS. 3 and 9, or a furniture nozzle 7, as shown in FIGS. 4 and 7, or for channeling dust or the like into a vacuum cleaner hose, when the accessory unit 1 is used as a brush nozzle 3.

Figure 2:
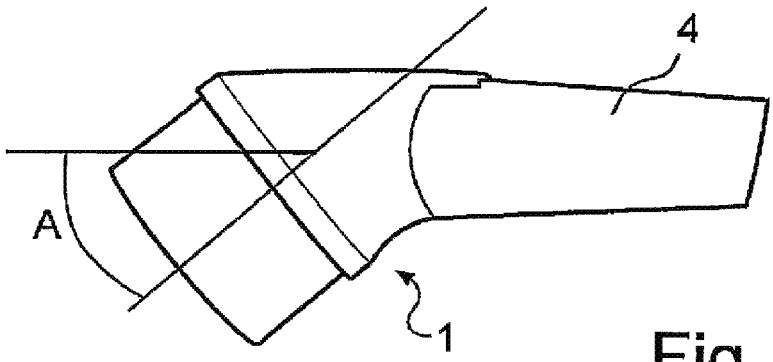
FIG. 2 is a side view of the accessory unit in FIG. 1.

In FIG. 2, there is illustrated a side view of the accessory unit 1 according to FIG. 1, in which one of the arms 4 may be seen. Each of the pivotally mounted arms 4 forms one half of the crevice nozzle in this embodiment. Reference character "A" denotes an angle between the longitudinal axes of the second tool end 2 and the first tool end 3, respectively.

Figure 3:
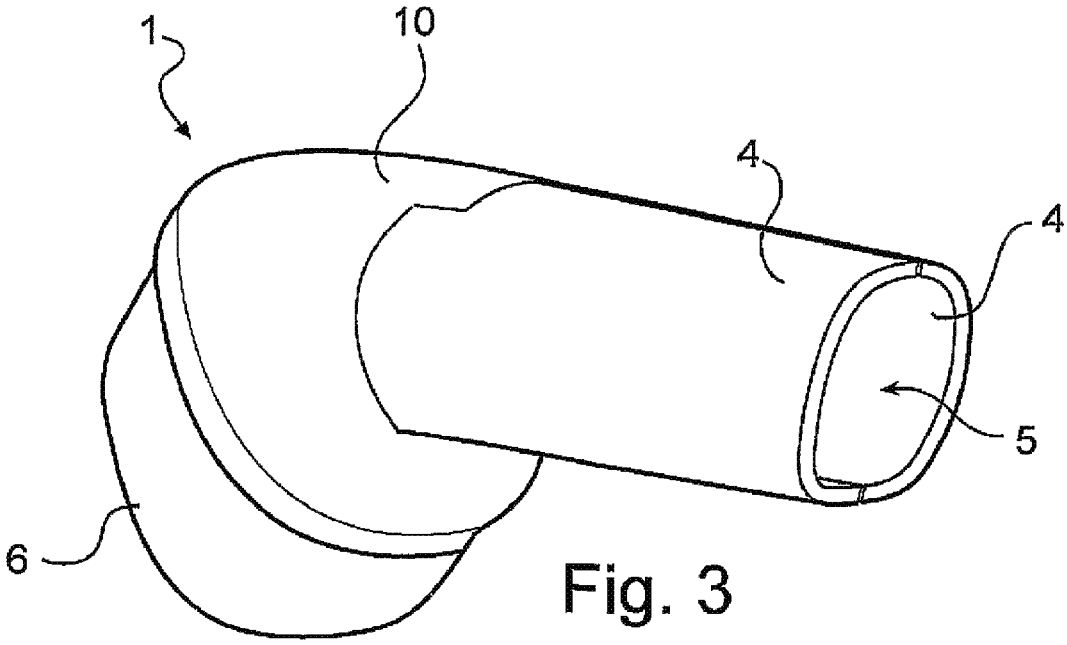
FIG. 3 is a perspective view of the accessory unit in FIG. 1.
Figure 4:
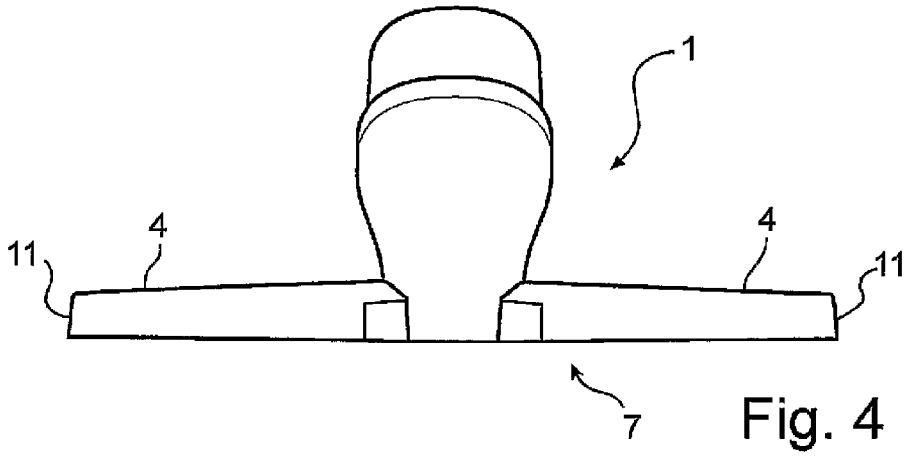
FIG. 4 shows the accessory unit of FIG. 1, wherein the accessory unit is formed as a furniture nozzle.

In a perspective view of the accessory unit according to FIG. 1, as seen in FIG. 3, the second tool end, when the arms 4 are folded or brought together to form a crevice nozzle, has an oblong cross section. Thereby, the accessory unit 1 is guided for insertion at a specific angle in the direction of longitudinal rotation of the crevice nozzle. In other words, the non-circular cross section forms a rotational lock fitting, preventing relative rotational movement between the accessory unit and the vacuum cleaner conduit.

Figure 5:
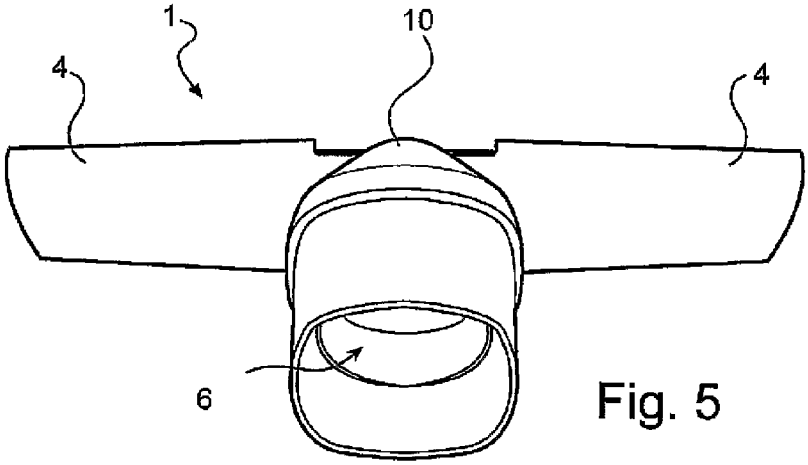
FIG. 5 is another perspective view of the accessory unit in FIG. 1.
Figure 6:
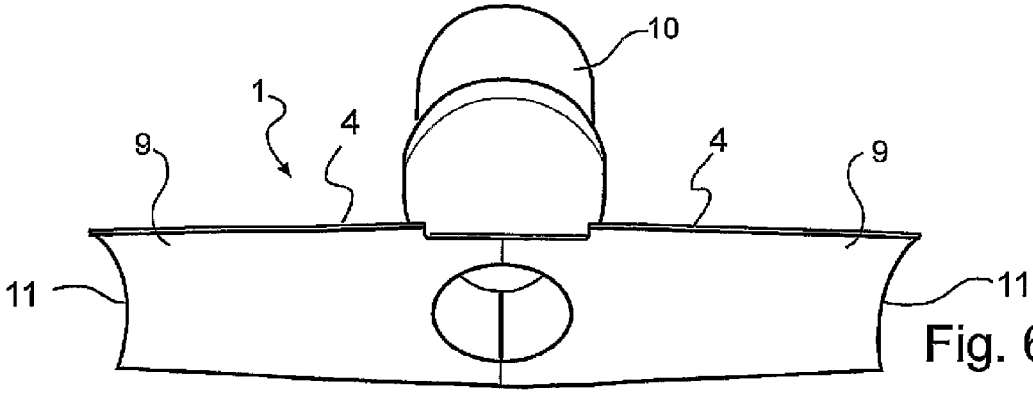
FIG. 6 is a further perspective view of the accessory unit in FIG. 1.

With reference to FIGS. 5 and 6, there is presented the accessory unit 1 according to FIG. 1, when the arms 4 of the tool end are unfolded to form a furniture nozzle 7. The pivotable arms 4 are now spread apart, such that the distal ends 9 and proximal ends 8 of both arms 4 are substantially arranged along a straight line. The distal ends 9 of each arm 4 are open 11 in the longitudinal direction of each arm 4. In FIG. 6, the sides of the arms 4 facing the surface to be vacuum cleaned are shown, when the arms 4 are formed as a furniture nozzle 7. As can be seen in FIG. 6, there is formed an elongated channel along the arms 4, which is open 11 in its distal ends 9.

FIGS. 7 through 11 illustrate how an accessory unit 1 according to an embodiment of the present invention is operated to change from a furniture nozzle, to a crevice nozzle and to a brush nozzle. Below, each state and transition from one nozzle to another will be explained in more detail.

In FIG. 7, there is illustrated a furniture nozzle 7, which is connected to a suction conduit 12 of a vacuum cleaner (not shown). In this state, the two arms 4 of the accessory unit 1 are, by means of their hinged connection to the housing, maximally spread apart, such that the arms 4 point in opposite directions.

Figure 8:
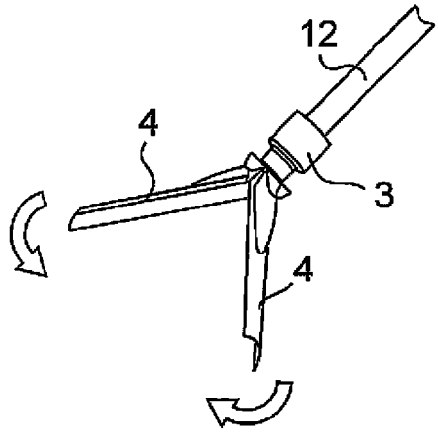

FIG. 8 shows a transition from a furniture nozzle into a crevice nozzle.

This transition may be performed without releasing the accessory unit 1 from the suction conduit 12 of the vacuum cleaner (not shown). The arms 4 of the accessory unit 1 are turned or folded together, thereby forming a nozzle having a generally tubular configuration (as seen in FIG. 9).

Moreover, in FIG. 9, reference numeral 2 denotes a crevice nozzle. In this state, the two arms 4 of the accessory unit 1 are placed alongside and brought into contact with each other. An opening 5 (see FIG. 1 and FIG. 3) is formed in the vicinity of the distal ends 9 thanks to the open ends 11 at the distal ends 9 of the arms 4. As shown, the brush nozzle 3 is releasably connected onto the vacuum cleaner conduit 12, i.e. the outer surface of the end of the vacuum cleaner conduit 12 bears against and engages the inner surface of the opening 6. The opening 6 is clearly denoted in FIG. 5.

Figure 10:
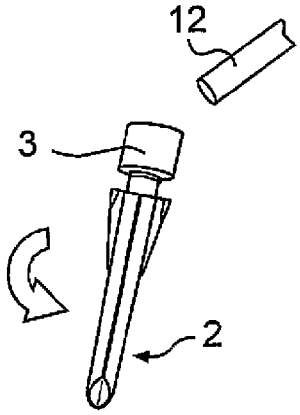

Referring to FIG. 10, there is displayed the removal of the accessory unit 1 from a vacuum cleaner conduit 12 in order to utilize the brush nozzle 3 for vacuum cleaning. When the accessory unit is detached from the suction conduit 12, the unit is reversed such that the second tool end 2 is facing the vacuum cleaner conduit 12 and the first tool end with the brush nozzle 3 is facing away from the suction conduit.

Figure 11:
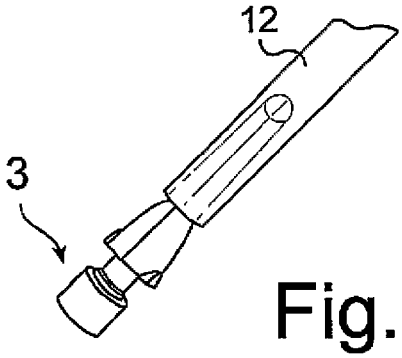

In FIG. 11, the last step for making the accessory unit 1 ready for use as a brush nozzle 3, is shown. The two arms 4 of the tool end have been inserted into the vacuum cleaner conduit 12. In this embodiment, the outer surfaces of the arms 4 are slightly tapered, whereby an air tight connection between the conduit 12 and the accessory unit 1 is provided.

It should be noted that the present invention has been illustrated using a few exemplifying embodiments. However, as is readily appreciated by a person skilled in the art, other embodiments than the ones disclosed above are also contemplated within the scope of the present invention, which is defined by the appended claims.

What is claimed is:

1. A vacuum cleaner accessory comprising:

a first tool end having a first nozzle;

a second tool end for releasable connection to a vacuum cleaner conduit, the second tool end having two pivotable arms, each pivotable arm comprising a distal end and a proximal end, the distal ends being arranged to move together to form a second nozzle, and move apart to form a third nozzle;

a housing for communicating vacuum suction air between the first tool end and the second tool end;

wherein the distal ends of the pivotable arms are pivotally mounted to the housing and the pivotable arms are arranged to be folded together for releasable connection of the second tool end to the vacuum cleaner conduit by insertion of the arms at least partially into the vacuum cleaner conduit.

2. The vacuum cleaner accessory of claim 1, wherein the accessory has a tapered section that tapers towards a distal end of the second tool end, whereby the accessory unit is adapted to engage the vacuum cleaner conduit at the tapered section.

3. The vacuum cleaner accessory of claim 2, wherein the tapered section is formed by the pivotable arms when the pivotable arms are arranged for releasable connection to the vacuum cleaner conduit.

4. The vacuum cleaner accessory of claim 2, wherein the tapered section is formed on the housing.

5. The vacuum cleaner accessory of claim 2, wherein the tapered section tapers continuously towards the distal end of the second tool end.

6. The vacuum cleaner accessory of claim 2, wherein the tapered section tapers in decremental steps towards the distal end of the second tool end.

7. The vacuum cleaner accessory of claim 2, wherein the tapered section has a frustoconical shape.

8. The vacuum cleaner accessory of claim 1, wherein the pivotable arms are arranged not to be in contact with each other when the pivotable arms are arranged for insertion into the vacuum cleaner conduit.

9. The vacuum cleaner accessory of claim 1, wherein the pivotable arms are arranged to contact each other when the pivotable arms are arranged for insertion into the vacuum cleaner conduit.

10. The vacuum cleaner accessory of claim 1, wherein the second tool end has a non-circular cross section when the pivotable arms are arranged for insertion into the vacuum cleaner conduit.

11. The vacuum cleaner accessory of claim 10, wherein the cross section is oblong.

12. The vacuum cleaner accessory of claim 11, wherein the cross section has the form of a super-ellipse.

13. The vacuum cleaner accessory of claim 1, wherein each pivotable arm comprises an elongated channel extending generally from the distal end to the proximal end of the pivotable arm, thereby enabling a longitudinal flow along each arm.

14. The vacuum cleaner accessory of claim 1, wherein the arms form an open end, when moved together to form the second nozzle.

15. The vacuum cleaner accessory of claim 1, wherein the first nozzle comprises a brush nozzle.

16. The vacuum cleaner accessory of claim 1, wherein the second nozzle comprises a crevice nozzle.

17. The vacuum cleaner accessory of claim 1, wherein the third nozzle comprises a furniture nozzle.

18. A vacuum cleaner assembly comprising:

a vacuum cleaner conduit; and, a vacuum cleaner accessory adapted to selectively connect to the vacuum cleaner conduit, the vacuum cleaner accessory comprising:

first tool end having a first nozzle;

a second tool end for releasable connection to the vacuum cleaner conduit, the second tool end having two pivotable arms, each pivotable arm comprising a distal end and a proximal end, the distal ends being arranged to move together to form a second nozzle, and move apart to form a third nozzle;

a housing for communicating vacuum suction air between the first tool end and the second tool end;

wherein the distal ends of the pivotable arms are pivotally mounted to the housing and the pivotable arms are arranged to be folded together for releasable connection of the second tool end to the vacuum cleaner conduit by insertion of the arms at least partially into the vacuum cleaner conduit.

19. The vacuum cleaner assembly of claim 18, wherein the vacuum cleaner conduit has a non-circular inner cross section, at least at an end thereof is adapted to receive the accessory therein.

20. The vacuum cleaner assembly of claim 19, wherein the inner cross section is oblong.

21. The vacuum cleaner assembly of claim 20, wherein the inner cross section is a super-ellipse.

22. A vacuum cleaner comprising:

a vacuum cleaner body;

a vacuum cleaner conduit fluidly connected to the vacuum cleaner body; and, a vacuum cleaner accessory adapted to selectively connect to the vacuum cleaner conduit, the vacuum cleaner accessory comprising:

first tool end having a first nozzle;

a second tool end for releasable connection to the vacuum cleaner conduit, the second tool end having two pivotable arms, each pivotable arm comprising a distal end and a proximal end, the distal ends being arranged to move together to form a second nozzle, and move apart to form a third nozzle;

a housing for communicating vacuum suction air between the first tool end and the second tool end;

wherein the distal ends of the pivotable arms are pivotally mounted to the housing and the pivotable arms are arranged to be folded together for releasable connection of the second tool end to the vacuum cleaner conduit by insertion of the arms at least partially into the vacuum cleaner conduit.

* * * * *

UNITED STATES PATENT AND TRADEMARK OFFICE

CERTIFICATE OF CORRECTION

PATENT NO. : 8,402,602 B2
APPLICATION NO. : 12/664180
DATED : March 26, 2013
INVENTOR(S) : Stefan Jonsson et al.

It is certified that error appears in the above-identified patent and that said Letters Patent is hereby corrected as shown below:

Title Page and at Column 1, line 1, should read;

ACCESSORY UNIT FOR A VACUUM CLEANER

Title Page should read;

(30) Foreign Application Priority Data

Jun. 12 2007 (SE).....0701439-2

Signed and Sealed this
Eighteenth Day of June, 2013

Teresa Stanek Rea
*Acting Director of the United States Patent and Trademark Office*